US009548169B1

(12) United States Patent
Kim

(10) Patent No.: US 9,548,169 B1
(45) Date of Patent: Jan. 17, 2017

(54) CONTACT STRUCTURE OF BATTERY RELAY AND BATTERY RELAY APPARATUS INCLUDING THE SAME

(71) Applicant: HYUNDAI MOTOR COMPANY, Seoul (KR)

(72) Inventor: Jin Gi Kim, Jeonju-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/956,557

(22) Filed: Dec. 2, 2015

(30) Foreign Application Priority Data

Oct. 19, 2015 (KR) ..... 10-2015-0145307

(51) Int. Cl.
*H01H 50/54* (2006.01)
*H01H 3/28* (2006.01)
*H01H 1/06* (2006.01)

(52) U.S. Cl.
CPC ..... *H01H 3/28* (2013.01); *H01H 1/06* (2013.01); *H01H 50/54* (2013.01); *H01H 50/546* (2013.01)

(58) Field of Classification Search
CPC H01H 1/06–1/10; H01H 50/54; H01H 50/546
See application file for complete search history.

(56) References Cited

U.S. PATENT DOCUMENTS 1,761,708 A * 6/1930 Cook ..... B66B 19/06 200/252
2,611,051 A * 9/1952 Van Kolff ..... G01D 5/39 200/11 R
2,641,670 A * 6/1953 Graves, Jr. ..... H01H 1/0233 200/264
4,668,843 A * 5/1987 Watanabe ..... G10H 1/344 200/1 B
6,303,887 B1 * 10/2001 Ando ..... H01H 13/702 200/1 B

FOREIGN PATENT DOCUMENTS

| | | |
|---|---|---|
| CN | 103845795 | 6/2014 |
| CN | 204271750 | 4/2015 |
| JP | H5-325758 | 12/1993 |
| JP | 2000-113790 | 4/2000 |
| JP | 2000-173375 | 6/2000 |

(Continued)

OTHER PUBLICATIONS

Korean Office Action for Application No. 10-2015-0145307 dated Sep. 28, 2016, 6 pages.

*Primary Examiner* — Ramon M Barrera
(74) *Attorney, Agent, or Firm* — Brinks Gilson & Lione

(57) ABSTRACT

A contact structure of a battery relay that is capable of reducing damage to relay contacts and a battery relay apparatus including the same are disclosed. The contact structure includes a movable contact unit including at least one first embossed contact formed adjacent to a center of the movable contact unit, the first embossed contact having a predetermined height, and at least one second embossed contact formed outside the first embossed contact, the second embossed contact having a lower height than the first embossed contact, and a stationary contact unit, the first embossed contact and the second embossed contact coming into contact with the stationary contact unit when power is turned on.

15 Claims, 4 Drawing Sheets

(56) References Cited

FOREIGN PATENT DOCUMENTS

| | | |
|---|---|---|
| JP | 2007-294216 | 11/2007 |
| JP | 2013-80566 | 5/2013 |
| JP | 2013-105557 | 5/2013 |
| KR | 10-0496688 | 6/2005 |
| KR | 10-1086907 | 11/2011 |
| KR | 10-1315721 | 10/2013 |
| KR | 10-2014-0097871 | 8/2014 |

* cited by examiner

CONTACT STRUCTURE OF BATTERY RELAY AND BATTERY RELAY APPARATUS INCLUDING THE SAME

CROSS-REFERENCE TO RELATED APPLICATIONS

This application claims the benefit of and priority to Korean Patent Application No. 10-2015-0145307, filed Oct. 19, 2015, which is incorporated herein by reference in its entirety.

FIELD

The present disclosure relates to a contact structure of a battery relay.

BACKGROUND

The statements in this section merely provide background information related to the present disclosure and may not constitute prior art.

A large-sized bus (e.g. an urban bus, an express bus, or a tourist bus) is provided with a large-capacity battery relay in order to drive loads mounted inside or outside the bus without using a start key.

For example, when a battery switch is pushed, irrespective of operation of the start key, contact voltage generated as a result of contact between contacts of the battery relay is applied to loads, such as a starter motor and a roof air conditioner.

When the battery switch is turned off during the operation of the loads, the contacts of the battery relay are separated from each other with the result that no voltage is applied to the loads. When the contacts of the battery relay come into contact with each other and/or are separated from each other, the contacts of the battery relay are frequently damaged (e.g. due to arcing).

Furthermore, in a case in which a large-capacity load is further connected to the battery relay, the quality of the battery relay is reduced due to the increase of the large-capacity load.

SUMMARY

The present disclosure provides a contact structure of a multiple contact type battery relay and a battery relay apparatus including the same.

In one form, a contact structure of a battery relay in accordance with the present disclosure includes a movable contact unit including at least one first embossed contact formed adjacent to the center of the movable contact unit, the first embossed contact having a predetermined height, and at least one second embossed contact formed outside the first embossed contact, the second embossed contact having a lower height than the first embossed contact, and a stationary contact unit, the first embossed contact and the second embossed contact coming into contact with the stationary contact unit when power is turned on.

The first embossed contact may have a height of 0.44 mm to 0.52 mm.

The second embossed contact may have a height of 0.35 mm to 0.43 mm.

The first embossed contact and the second embossed contact may have the shape of concentric circles.

In another aspect of the present disclosure, a battery relay apparatus includes a movable contact unit including at least one first embossed contact formed adjacent to the center of the movable contact unit, the first embossed contact having a predetermined height, and at least one second embossed contact formed outside the first embossed contact, the second embossed contact having a lower height than the first embossed contact, a stationary contact unit, the first embossed contact and the second embossed contact coming into contact with the stationary contact unit when power is turned on, and at least one load unit configured to receive contact voltage generated as a result of contact between the movable contact unit and the stationary contact unit.

The first embossed contact may have a height of 0.44 mm to 0.52 mm.

The second embossed contact may have a height of 0.35 mm to 0.43 mm.

The first embossed contact and the second embossed contact may have the shape of concentric circles.

An electronic device having the load unit mounted therein may include a refrigerator, an audio system, a lamp, an electronic control unit, an air conditioner, and a starter motor.

In a further aspect of the present disclosure, a battery relay apparatus includes a stationary contact unit including at least one stationary contact arranged at intervals, an exciting coil unit formed under the stationary contact unit for generating a magnetic field using voltage supplied from a power unit, a movable contact unit including at least one first embossed contact formed adjacent to the center of the movable contact unit, the first embossed contact having a predetermined height, and at least one second embossed contact formed outside the first embossed contact, the second embossed contact having a lower height than the first embossed contact, and a plunger unit coupled to the movable contact unit for moving the movable contact unit downward to the stationary contact unit using mobile power generated by the magnetic field.

The first embossed contact and the second embossed contact may come into contact with the stationary contact unit when the movable contact unit is moved downward to the stationary contact unit.

The first embossed contact may have a height of 0.44 mm to 0.52 mm.

The second embossed contact may have a height of 0.35 mm to 0.43 mm.

The first embossed contact and the second embossed contact may have the shape of concentric circles.

The battery relay apparatus may further include at least one load unit configured to receive contact voltage generated as a result of contact between the movable contact unit and the stationary contact unit.

An electronic device having the load unit mounted therein may include a refrigerator, an audio system, a lamp, an electronic control unit, an air conditioner, and a starter motor.

The battery relay apparatus may further include a spring unit formed under the plunger unit, wherein the spring unit may be driven to release the contact between the movable contact unit and the stationary contact unit when no voltage is applied to the exciting coil unit.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 3 is a sectional view showing a contact state of the battery relay apparatus of FIG. 2 when power is turned on;

Figure 1:
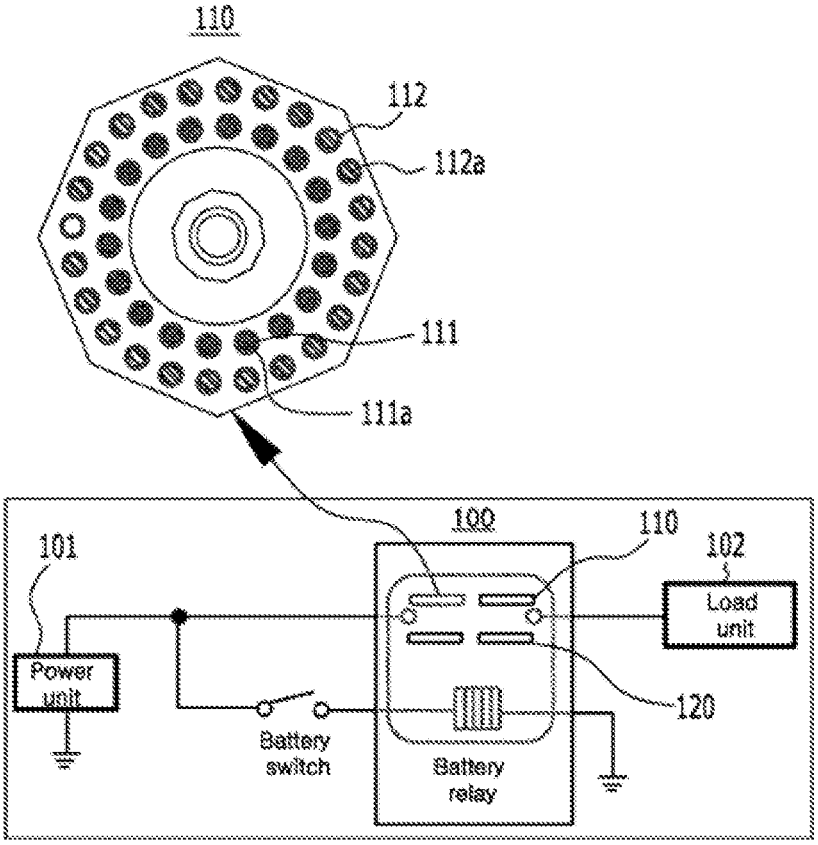
FIG. 1 is a view schematically showing an example of the construction of a contact structure of a battery relay according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Reference will now be made in detail to various forms of the present disclosure, examples of which are illustrated in the accompanying drawings. The suffix "unit" of elements herein is used for convenience of description and thus can be used interchangeably, and does not have any distinguishable meanings or functions.

Hereinafter, various apparatuses to which the following forms of the present disclosure are applied will be described in more detail with reference to the accompanying drawings.

<Example of Battery Relay>

FIG. 1 is a view schematically showing an example of a construction of a contact structure of a battery relay according to an one form of the present disclosure.

Referring to FIG. 1, a contact structure of a battery relay 100 according to embodiment form of the present disclosure may include a movable contact unit 110 and a stationary contact unit 120.

The movable contact unit 110 includes at least one first embossed contact 111 formed adjacent to the center of the movable contact unit 110, the first embossed contact 111 having an embossed shape, and at least one second embossed contact 112 formed outside the first embossed contact 111, the second embossed contact 112 having the same embossed shape as the first embossed contact 111.

The first embossed contact 111 has a predetermined height. For example, the first embossed contact 111 may have a height (height of the embossed shape) of 0.44 mm to 0.52 mm.

The at least one first embossed shape 111*a* may be formed along the concentric circle at predetermined intervals.

The second embossed contact 112 has a lower height than the first embossed contact 111. For example, the second embossed contact 112 may have a height of 0.35 mm to 0.43 mm.

The second embossed contact 112 may have at least one second embossed shape 112*a* formed along a concentric circle adjacent to the first embossed contact 111 and, further, to the outside of the first embossed contact 111.

The at least one second embossed shape 112*a* may be formed along the concentric circle at predetermined intervals.

When a power unit 101 is powered on, the first embossed contact 111 and the second embossed contact 112 of the movable contact unit 110 contact the stationary contact unit 120.

More specifically, when the power unit 101 is powered on, the movable contact unit 110 moves to the stationary contact unit 120, and then the first embossed contact 111 and the second embossed contact 112 of the movable contact unit 110 contact the stationary contact unit 120.

The embossed height of the second embossed contact 112 is lower than that of the first embossed contact 111 in order to eliminate imbalance of resistance between the second embossed contact 112 and the first embossed contact 111, thereby inhibiting damage to the contacts due to an arc phenomenon therebetween.

Imbalance of resistance between the first embossed contact 111 and the second embossed contact 112 may occur since the maximum magnitude of current from the power unit 101 is supplied to the second embossed contact 112, but current having a magnitude lower than the maximum magnitude of the current supplied to the second embossed contact 112 is supplied to the first embossed contact 111 after the supply of current to the second embossed contact 112.

In a case in which the embossed height of the second embossed contact 112 is lower than that of the first embossed contact 111, as described above, resistance between the first embossed contact 111 and the second embossed contact 112 is equalized, thereby inhibiting damage to the contacts.

Contact voltage generated as a result of contact between the movable contact unit 110 and the stationary contact unit 120 may be applied to a load unit 102.

The load unit 102 is connected to the battery relay 100, which includes the movable contact unit 110 and the stationary contact unit 120, such that contact voltage generated by the battery relay 100 is applied to the load unit 102.

An electronic device having the load unit 102 mounted therein may include a refrigerator, an audio system, a lamp, an electronic control unit, an air conditioner, and/or a starter motor. However, the present disclosure is not limited thereto. Any electronic device that can be operated when voltage is applied thereto may be included in the category of the electronic device specified in this form of the present disclosure.

Meanwhile, the contact structure of the battery relay 100 may further include exciting coil and plunger structures for achieving contact between the movable contact unit 110 and the stationary contact unit 120. The exciting coil and plunger structures will be described in more detail when describing the following forms.

<Example of Battery Relay Apparatus>

Figure 2:
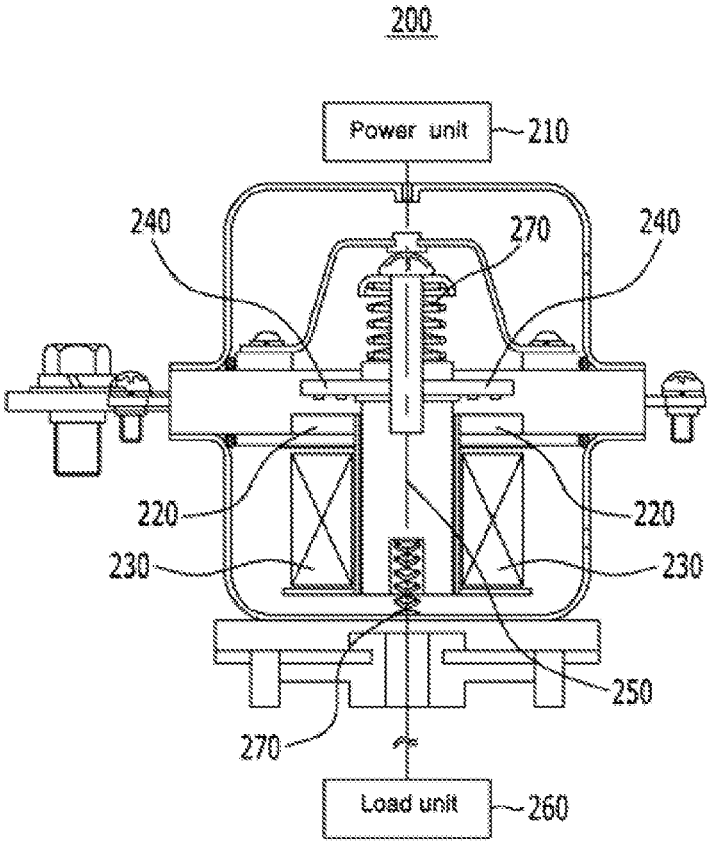
FIG. 2 is a sectional view showing an example of a battery relay apparatus according to one form of the present disclosure.
Figure 3:
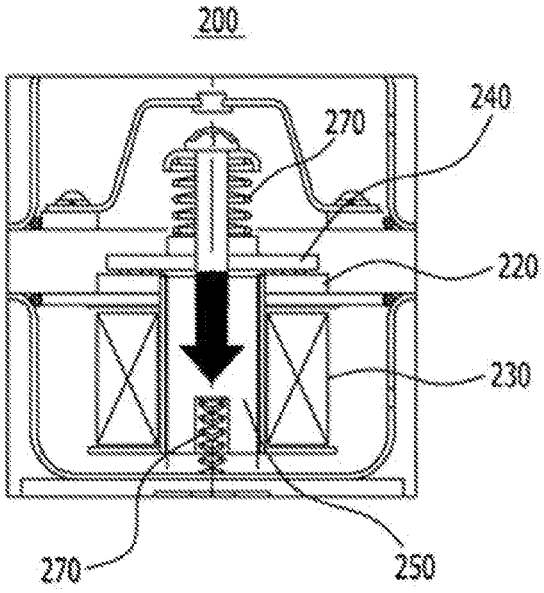
Figure 4:
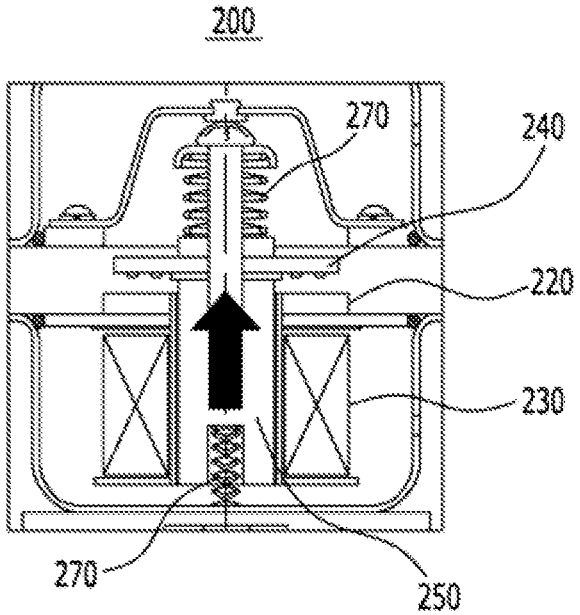
FIG. 4 is a sectional view showing a non-contact state of the battery relay apparatus of FIG. 2 when power is turned off.
Figure 5:
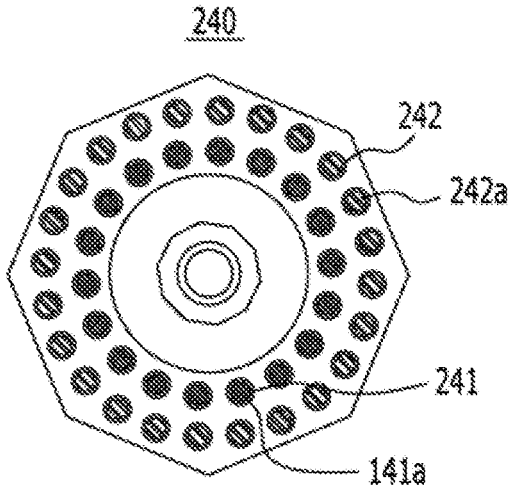
FIG. 5 is a view showing the shape of a movable contact unit included in the battery relay apparatus of FIG. 2.

FIG. 2 is a sectional view showing an example of a battery relay apparatus according to one form of the present disclosure, FIG. 3 is a sectional view showing a contact state of the battery relay apparatus of FIG. 2 when power is turned on, FIG. 4 is a sectional view showing a non-contact state of the battery relay apparatus of FIG. 2 when power is turned off, and FIG. 5 is a view showing the shape of the movable contact unit included in the battery relay apparatus of FIG. 2.

FIGS. 3 to 5 shall be referenced when describing FIG. 2.

Referring to FIG. 2, a battery relay apparatus 200 according to one form of the present disclosure may include a power unit 210, a stationary contact unit 220, an exciting coil unit 230, a movable contact unit 240, a plunger unit 250, a load unit 260, and a spring unit 270.

The power unit 210 may generate voltage using electric power supplied from a battery (not shown). For example, the power unit 210 may generate voltage including current of 200 A, 400 A, and 600 A.

The stationary contact unit 220 may include at least one stationary contact arranged at intervals. For example, the stationary contact unit 220 may include two stationary contacts.

The exciting coil unit 230 may include at least one exciting coil formed under the stationary contact unit 220 for generating a magnetic field using voltage supplied from the power unit 210.

The number of the at least one exciting coil is equal to that of the at least one stationary contact. The at least one exciting coil may be disposed under the at least one stationary contact in a symmetrical fashion.

As shown in FIG. 5, the movable contact unit 240 includes at least one first embossed contact 241 formed adjacent to the center of the movable contact unit 240, the first embossed contact 241 having an embossed shape, and at least one second embossed contact 242 formed outside the first embossed contact 241, the second embossed contact 242 having the same embossed shape as the first embossed contact 241.

The first embossed contact 241 has a predetermined height. For example, the first embossed contact 241 may have a height (height of the embossed shape) of 0.44 mm to 0.52 mm.

As shown in FIG. 5, the first embossed contact 241 may have at least one first embossed shape 241*a* formed along a concentric circle adjacent to the center of the movable contact unit 240.

The at least one first embossed shape 241*a* may be formed along the concentric circle at predetermined intervals.

The second embossed contact 242 has a lower height than the first embossed contact 241. For example, the second embossed contact 242 may have a height of 0.35 mm to 0.43 mm.

The second embossed contact 242 may have at least one second embossed shape 242*a* formed along a concentric circle adjacent to the first embossed contact 241 and, in addition, to the outside of the first embossed contact 241.

The at least one second embossed shape 242*a* may be formed along the concentric circle at predetermined intervals.

The plunger unit 250 may be coupled to the lower part of the movable contact unit 240 or to the upper and lower parts of the movable contact unit 240 and, at the same time, inside the exciting coil unit 230.

The plunger unit 250 may generate mobile power using a magnetic field generated from the exciting coil unit 230.

The mobile power is force that pulls the plunger unit 250 downward. The movable contact unit 240, which is coupled to the upper part of the plunger unit 250, may be moved downward using the mobile power. As shown in FIG. 3, the mobile power may move the movable contact unit 240 downward to such an extent that the movable contact unit 240 contacts the stationary contact unit 220.

As the movable contact unit 240 is moved downward after the power unit 210 is powered on, the first embossed contact 241 and the second embossed contact 242 of the movable contact unit 240 may contact the stationary contact unit 220.

The embossed height of the second embossed contact 242 is lower than that of the first embossed contact 241 in order to eliminate imbalance of resistance between the second embossed contact 242 and the first embossed contact 241, thereby inhibiting damage to the contacts due to an arc phenomenon therebetween.

Imbalance of resistance between the first embossed contact 241 and the second embossed contact 242 may occur since the maximum magnitude of current from the power unit 210 is supplied to the second embossed contact 242, but current having a magnitude lower than the maximum magnitude of the current supplied to the second embossed contact 242 is supplied to the first embossed contact 241 after the supply of the current to the second embossed contact 242.

In a case in which the embossed height of the second embossed contact 242 is lower than that of the first embossed contact 241, as described above, resistance between the first embossed contact 241 and the second embossed contact 242 is equalized, thereby inhibiting damage to the contacts.

Contact voltage generated as a result of contact between the movable contact unit 240 and the stationary contact unit 220 may be applied to the load unit 260.

The load unit 260 is connected to the battery relay apparatus 200, which includes the movable contact unit 240 and the stationary contact unit 220, such that contact voltage generated by the battery relay apparatus 200 is applied to the load unit 260.

The spring unit 270 is formed under the plunger unit 250. When no voltage is applied to the exciting coil unit 230, the spring unit 270 is driven to release contact between the movable contact unit 240 and the stationary contact unit 220.

To this end, the spring unit 270 may provide elastic force to the plunger unit 250 such that the plunger unit 250 is movable upward and downward.

For example, as shown in FIG. 3, when power is turned on, the plunger unit 250 and/or the movable contact unit 240 is moved downward due to elastic force of the spring unit 270, thereby achieving contact between the movable contact unit 240 and the stationary contact unit 220.

On the other hand, as shown in FIG. 4, when power is turned off, the plunger unit 250 and/or the movable contact unit 240 is moved upward due to elastic force of the spring unit 270, thereby interrupting contact between the movable contact unit 240 and the stationary contact unit 220.

The spring unit 270 may be further formed on the plunger unit 250. However, the present disclosure is not limited thereto.

<Example of Electrical Connection of the Battery Relay Apparatus>

Figure 6:
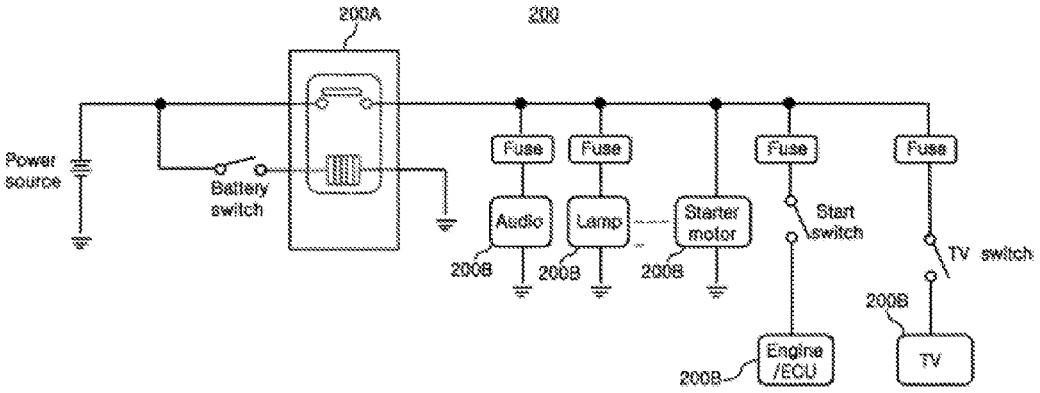
FIG. 6 is a diagram showing an electrical connection of the battery relay apparatus of FIG. 2.

FIG. 6 is a diagram showing electrical connection of the battery relay apparatus of FIG. 2.

Referring to FIG. 6, the battery relay apparatus 200 may include a battery relay 200A and an electronic device 200B connected to the battery relay 200A.

The battery relay 200A may include a power unit 210, a stationary contact unit 220, an exciting coil unit 230, a movable contact unit 240, a plunger unit 250, and a spring unit 270, as described above with reference to FIGS. 2 to 5. These units of the battery relay 200A are identical to those described above with reference to FIGS. 2 to 5, and therefore a description thereof will be omitted.

The electronic device 200B may be frequently connected to the battery relay 200A. The electronic device 200B may include a load unit 250 as described above with reference to FIGS. 2 to 5. The load unit 250 of the electronic device 200B is identical to that described above with reference to FIGS. 2 to 5, and therefore a description thereof will be omitted.

The electronic device 200B having the load unit 260 mounted therein may include a television (TV), a refrigerator, an audio system, a lamp, an electronic control unit, an air conditioner, and/or a starter motor. However, The present disclosure is not limited thereto. Any electronic device that can be operated when voltage is applied thereto may be included in the category of the electronic device specified in this form of the present disclosure.

A fuse, a start switch, and/or a TV switch, together with a battery switch, may be provided between the battery relay 200A and the electronic device 200B.

<Example of Evidence>

Figure 7:
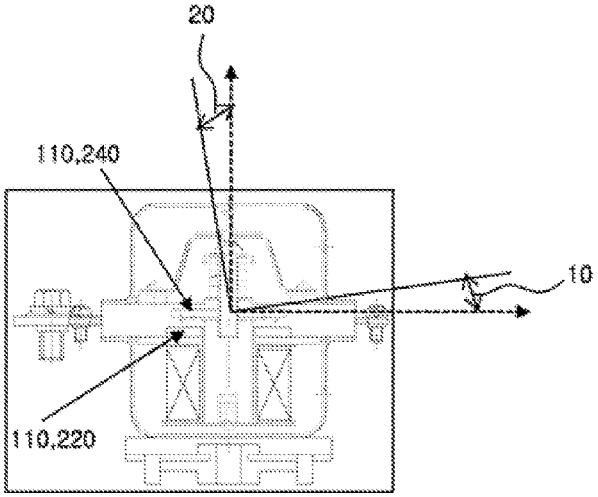
FIG. 7 is a view showing concentricity and parallelism between the movable contact unit and a stationary contact unit of FIGS. 1 to 6.

FIG. 7 is a view showing concentricity and parallelism between the movable contact unit and the stationary contact unit of FIGS. 1 to 6.

The first embossed contact 111 or 241 may have an embossed height of 0.44 mm to 0.52 mm, and the second embossed contact 112 or 242 may have a lower height than the first embossed contact 111 or 241, for example an embossed height of 0.35 mm to 0.43 mm, as described above with reference to FIGS. 1 to 6.

For example, in a case in which the first embossed contact 111 or 241 has an embossed height of 0.48 mm, and the second embossed contact 112 or 242 has an embossed height of 0.39 mm, when the stationary contact unit 120 or 220 and the movable contact unit 110 or 240 contact each other, parallelism 10 and concentricity 20 between the contacts approximates zero, which means that parallelism 10 and concentricity 20 between the contacts are high.

In a case in which parallelism 10 and concentricity 20 between the contacts are high, it is possible to increase durability of the battery relay apparatus 200.

<Example of Effects>

In the battery relay and/or the battery relay apparatus including the battery relay, as shown in FIGS. 1 to 7, the stationary contact unit 120 or 220 and the movable contact unit 110 or 240 contact each other when the first embossed contact 111 or 241 has an embossed height of 0.48 mm, and the second embossed contact 112 or 242 has an embossed height of 0.39 mm.

It is possible to obtain the effects shown in Table 1 through contact as described above. As shown in Table 1, experiments of fusion between the contacts through electric conduction were carried out using current of 200 A, 400 A, and 600 A. At this time, power was turned on and off 300 times. Bounce and return times shown in Table 1 were measured five times in a cold state and a hot state, and were averaged.

TABLE 1

| Classification | fusion between contacts through electric conduction (12) | | | Bounce and return times (ms) | | | |
|---|---|---|---|---|---|---|---|
| | | | | Bounce | | Return | |
| | 200A | 400A | 600A | Cold | Hot | Cold | Hot |
| Conventional art | None | 3 (fused when contacting 10, 50, and 90 times) | 6 (fused when contacting 3, 5, 10, 20, and 50 times) | 10.3 | 29.3 | 0.02 | 0.05 |
| Present disclosure | None | 2 (fused when contacting 90 and 270 times) | 1 (fused when contacting 80 times) | 4.3 | 4.5 | 0.01 | 0.01 |

When the stationary contact unit 120 or 220 and the movable contact unit 110 or 240 contact each other in a state in which current of 200 A, 400 A, and 600 A is supplied, the contacts may be fused. It can be seen from Table 1 that, in the present disclosure, the frequency of fusion between the contacts at current of 400 A and 600 A is lower than in the conventional art, whereby damage to the contacts is reduced.

Furthermore, in Table 1, the bounce and return times indicate a degree of shaking of the stationary contact unit 120 or 220 and the movable contact unit 110 or 240, which contact each other when power is turned on. It can be seen that, in the present disclosure, the bounce and return times in the cold state and the hot state are shorter than in the conventional art.

As is apparent from the above description, in the present disclosure, a multiple contact type first embossed contact and a multiple contact type second embossed contact have different heights. As a result, contact resistance is equalized, thereby inhibiting damage to the contacts due to arcing.

In addition, in the present disclosure, a multiple contact type first embossed contact and a multiple contact type second embossed contact have different heights. As a result, fusion between the contacts based on the magnitude of current is reduced, thereby increasing the durability of a battery relay and a battery relay apparatus including the battery relay.

In addition, in the present disclosure, bounce and return times occurring during on and off operations of a battery relay are reduced, thereby further increasing durability of the battery relay.

Furthermore, in the present disclosure, a multiple contact type first embossed contact and a multiple contact type second embossed contact have different heights, thereby stably maintaining concentricity and parallelism between the contacts.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A contact structure of a battery relay comprising:

a movable contact unit comprising:

at least one first embossed contact formed adjacent to a center of the movable contact unit, the first embossed contact having a predetermined height, and at least one second embossed contact formed outside the first embossed contact, the second embossed contact having a lower height than the first embossed contact; and a stationary contact unit, the first embossed contact and the second embossed contact coming into contact with the stationary contact unit when power is turned on.

2. The contact structure according to claim 1, wherein the first embossed contact has a height of 0.44 mm to 0.52 mm.

3. The contact structure according to claim 2, wherein the second embossed contact has a height of 0.35 mm to 0.43 mm.

4. The contact structure according to claim 1, wherein the first embossed contact and the second embossed contact have a shape of concentric circles.

5. A battery relay apparatus comprising:

a movable contact unit comprising at least one first embossed contact formed adjacent to a center of the movable contact unit, the first embossed contact having a predetermined height, and at least one second embossed contact formed outside the first embossed contact, the second embossed contact having a lower height than the first embossed contact;

a stationary contact unit, the first embossed contact and the second embossed contact coming into contact with the stationary contact unit when power is turned on; and at least one load unit configured to receive contact voltage generated as a result of contact between the movable contact unit and the stationary contact unit.

6. The battery relay apparatus according to claim 5, wherein the first embossed contact has a height of 0.44 mm to 0.52 mm.

7. The battery relay apparatus according to claim 6, wherein the second embossed contact has a height of 0.35 mm to 0.43 mm.

8. The battery relay apparatus according to claim 5, wherein the first embossed contact and the second embossed contact have a shape of concentric circles.

9. The battery relay apparatus according to claim 5, wherein an electronic device having the load unit mounted therein is at least one of a refrigerator, an audio system, a lamp, an electronic control unit, an air conditioner, and a starter motor.

10. A battery relay apparatus comprising:

a stationary contact unit comprising at least one stationary contact arranged at intervals;

an exciting coil unit formed under the stationary contact unit for generating a magnetic field using voltage supplied from a power unit;

a movable contact unit comprising at least one first embossed contact formed adjacent to a center of the movable contact unit, the first embossed contact having a predetermined height, and at least one second embossed contact formed outside the first embossed contact, the second embossed contact having a lower height than the first embossed contact;

a plunger unit coupled to the movable contact unit for moving the movable contact unit downward to the stationary contact unit using mobile power generated by the magnetic field; and at least one load unit configured to receive contact voltage generated as a result of contact between the movable contact unit and the stationary contact unit, wherein the first embossed contact and the second embossed contact come into contact with the stationary contact unit when the movable contact unit is moved downward to the stationary contact unit.

11. The battery relay apparatus according to claim 10, wherein the first embossed contact has a height of 0.44 mm to 0.52 mm.

12. The battery relay apparatus according to claim 11, wherein the second embossed contact has a height of 0.35 mm to 0.43 mm.

13. The battery relay apparatus according to claim 10, wherein the first embossed contact and the second embossed contact have a shape of concentric circles.

14. The battery relay apparatus according to claim 10, wherein an electronic device having the load unit mounted therein is at least one of a refrigerator, an audio system, a lamp, an electronic control unit, an air conditioner, and a starter motor.

15. The battery relay apparatus according to claim 10, further comprising a spring unit formed under the plunger unit, wherein the spring unit is driven to release the contact between the movable contact unit and the stationary contact unit when no voltage is applied to the exciting coil unit.

* * * * *